US006163315A

United States Patent [19]

Lee et al.

[11] Patent Number: 6,163,315

[45] Date of Patent: Dec. 19, 2000

[54] PROCESS FOR DETECTING AND ADJUSTING THE SYNCHRONIZATION OF VIDEO SIGNAL FOR DISPLAYING

[75] Inventors: Tian-Quey Lee, Hsin-Chu; Cheng-Pang Chien, Chung-Ho, both of Taiwan

[73] Assignee: Mustek Systems Inc., Hsin-chu, Taiwan

[21] Appl. No.: 09/206,553

[22] Filed: Dec. 8, 1998

[51] Int. Cl.[7] ..... G09G 5/12

[52] U.S. Cl. ..... 345/213; 348/511

[58] Field of Search ..... 348/511; 345/213; H04N 3/22, 3/227

[56] References Cited

U.S. PATENT DOCUMENTS 5,251,031 10/1993 Tagami ..... 348/194

6,008,791 12/1999 Arai et al. ..... 345/132

*Primary Examiner*—Bipin Shalwala

*Assistant Examiner*—Vincent E. Kovalick

*Attorney, Agent, or Firm*—Rosenberg, Klein & Lee

[57] ABSTRACT

A process in displaying a video signal according to a sequence of synchronous pulses is disclosed. The process is based on the adjustment of timing of the active part of a video signal to be displayed. That is the starting point of active part of the video signal for each line-displaying is properly and immediately adjusted according to the detection if the trailing end of the previous active part of the video signal lags the synchronization pulse next to its leading end, whereby it can be achieved that the video signal is always displayed in a specified region and synchronization failure can be avoided.

20 Claims, 4 Drawing Sheets

PROCESS FOR DETECTING AND ADJUSTING THE SYNCHRONIZATION OF VIDEO SIGNAL FOR DISPLAYING

FIELD OF THE INVENTION

The present invention generally relates to a process in displaying a video signal according to a sequence of synchronous pulses, and particularly to a process in adjusting the timing of the active part of a video signal to be displayed.

BACKGROUND OF THE INVENTION

The number of pixels in each line of a display such as a LCD is usually fixed, while that designed for a horizontal line of a video card varies with different products, resulting in the possibility that the number of pixels in a video signal exceeds what a display (such as a LCD) can display line bar line.

A display usually displays messy images as a result that the active part of a video signal falls beyond the right boundary of its displaying region, leading to the need that an user does manual adjustment according to his experience and luck, to restore the order of displaying the video signal. Even the user eventually succeeds in the adjustment, the displayed messy images and the associated adjustments make people frustrated and annoyed.

Therefore it is expected by many people and related industries that a circuit or a process is designed to provide a solution of maintaining stable image displaying on the screen of a display such as a LCD.

When displaying a video signal in a display based on a sequence of synchronous pulses, the active part of the video signal must be between two successive synchronous pulses, in order to display the image of a video signal in a proper region line by line on the screen of the display. As shown in FIG. 1. active part 11 of the video signal must be between two synchronous pulses 13 or within a synchronous cycle 15 (a cyclical period), to assure the image 17 carried by the video signal is displayed in a region line by line corresponding to the sequence of synchronous pulses, i.e., line by line in a region determined according to the continuous synchronous pulses such as the synchronous pulses 13.

Sometimes it may happen that the active part 11 of a video signal extends endlessly, as shown in FIG. 2*a*, as a result of synchronization failure, leading to a permanent mess on the screen of the display.

A block diagram showing a conventional algorithm for adjusting the timing of the active part of the video signal for displaying image line by line is shown in FIG. 2*b*, where process 32 inputs a video signal 41, a signal 45 representing the setting or adjusting by users, and synchronous pulse 46, for detecting the synchronization of image and adjusting the timing of starting image displaying. Without design of relevant detection process or circuit, adjusting for the synchronization of image relies solely on users' experience and luck instead of automatic operation. It can thus be seen that the conventional algorithm does not monitor closely the timing of the active part of a video signal, thereby can't prevent synchronous failure from causing serious screen mess.

SUMMARY OF THE INVENTION

Objects

It is therefore an object of the present invention to provide a process to be used in adjusting the timing of the active part of a video signal, in order to assure the image of the active part of the video signal is displayed line by line in a specified region on the screen.

It is therefore another object of the present invention to provide a process to be used in displaying the image of a video signal, to assure reliable synchronization and stable image displaying.

A further object of the present invention is to provide a process of reliably displaying video signals.

Operating Algorithm

According to the present invention, the algorithm for a process of adjusting, according to a sequence of synchronous pulses, the timing of the active part of a video signal to be displayed, is characterized by the following steps:

(1). detecting if the trailing end of each active part of the video signal lags the synchronous pulse which is next to the leading end of the active part of the video signal, in order to detect if the image defined by each active part of the video signal falls beyond the right boundary of the region specified for displaying the image;

(2). in case the trailing end of an active part of the video signal lags the synchronous pulse which is next to the leading end of the active part of the video signal, advancing the active part of the video signal by an adjustment step value in the next cyclical period following the synchronous pulse, i.e., if the image defined by an active part of the video signal falls beyond the right boundary of the region specified for displaying the image, the image displayed in the next line will be moved to the left by a distance corresponding to the adjustment step value;

(3). repeating step (1) and step (2) until the trailing end of the active part of the video signal leads, by a leading time period, the synchronous pulse which is next to the leading end of the active part of the video signal, the leading time period has minimum length of zero, i.e., repeating step (1) and step (2) until the trailing end of the active part of the video signal in each cyclical period does not lag the synchronous pulse which is next to the leading end of the active part of the video signal, in order to immediately put, as soon as possible, the image of the video signal back in the region specified for displaying the image line by line.

In the above process, a step of choosing a tentative lag value may be added before step (1), and step (2) comprises the steps of:

(2-1). decreasing the tentative lag value by the adjustment step value;

(2-2). waiting a time period after the synchronous pulse to start the active part of the video signal, the time period is equivalent to the tentative lag value, so that the phase difference between the synchronous pulse and the following leading end of the active part of the video signal is equivalent to the tentative lag value (i.e., the phase difference equals the tentative lag value or differs from the tentative lag value by a small value) which has been decreased by the adjustment step value and will be decreased by the adjustment step value for each cyclical period until the trailing end of the active part of the video signal in a cyclical period does not lag the synchronous pulse ending the cyclical period. Obviously the active part of the video signal is thus advanced by the adjustment step value in each cyclical period until the trailing end of the active part of the video signal in a cyclical period does not lag the synchronous pulse ending the cyclical period.

In the above process, step (3) may further comprise a step of recording the tentative lag value for next time to start the process of adjust the timing of the active part of the video signal, when the trailing end of the active part of the video signal leads, by a leading time period. the synchronous pulse which is next to the leading end of the active part of the video signal, and the leading time period has minimum length of zero; i.e. recording the tentative lag value when the trailing end of the active part of the video signal does not lag the synchronous pulse which is next to the leading end of the active part of the video signal.

Another way to implement the above step (2) comprises the steps of decreasing the tentative lag value by the adjustment step value; starting, in response to the synchronous pulse, to count a sequence of clock pulses to obtain a counting number; starting the active part of the video signal when the counting number is equivalent to the tentative lag value, thereby the active part of the video signal is advanced by the adjustment step value.

The above process further comprises a step of providing, in response to the synchronous pulse, the sequence of clock pulses.

Step (2-2) in the above process further comprises a step of starting a timer in response to the synchronous pulse, so that the active part of the video signal is started when the time period is counted. Obviously a step of choosing the adjustment step value which is not bigger than the tentative lag value may be added before the step (1) above.

It must be noted that the time period is equivalent to the tentative lag value means the difference between the time period and the tentative lag value is within a certain range which is reasonably small. Of course it may also mean both the time period and the tentative lag value are equal, and in time measuring unit such as second, millisecond, or microsecond.

In the above process, a flip-flop may be used to input the active part of the video signal and the synchronous pulse, for detecting if the trailing end of the active part of the video signal lags the synchronous pulse which is next to the leading end of the active part of the video signal.

The present invention may also be embodied as a process in displaying a video signal according to a sequence of synchronous pulses and a tentative lag value. The algorithm for the process may be characterized by the following steps:

waiting a time period after the synchronous pulse to provide the active part of the video signal, the time period is equivalent to the tentative lag value;

detecting if the trailing end of the active part of the video signal lags the synchronous pulse which is next to the leading end of the active part of the video signal;

in case the trailing end of the active part of the video signal lags the synchronous pulse which is next to the leading end of the active part of the video signal, decreasing the tentative lag value by an adjustment step value;

repeating the above three steps until the trailing end of the active part of the video signal leads, by a leading time period, the synchronous pulse which is next to the leading end of the active part of the video signal, the leading time period has minimum length of zero, i.e., repeating the above three steps until the trailing end of the active part of the video signal does not lag the synchronous pulse which is next to the leading end of the active part of the video signal, so that the starting point (starting time) for displaying the active part of the video signal is advanced early enough to avoid the synchronization failure which is caused by too much lag of the trailing end of active part of the video signal behind next synchronization pulse, and at the same time the stability and quality of video display is maintained at a better.

Steps of forming the active part with length (the length of duration of an active part of the video signal) equal an active part length value which is not larger than the cyclical period of the sequence of pulses may be added in the above process. These steps are:

starting, in response to the synchronous pulse, to count a sequence of clock pulses to obtain a counting number;

starting the active part of the video signal when the counting number is equivalent to the tentative lag value. so that the active part of the video signal lags the synchronous pulse by the tentative lag value;

when the counting number is equivalent to the tentative lag value, also starting to count the sequence of clock pulses to obtain a counting number for active part length;

ending the active part of the video signal when the counting number for active part length is equivalent to the active part length value, thereby the length of duration of an active part of the video signal is equal or equivalent to the active part length value.

No matter which of the above processes is adopted for embodying the present invention, a flip-flop can be used to input the active part of the video signal and the synchronous pulse, in order to detect if the trailing end of the active part of the video signal lags the synchronous pulse which is next to the leading end of the active part of the video signal.

The present invention may best be understood through the following description with reference to the accompanying drawings, in which:

DETAILED DESCRIPTION OF THE PREFERRED EMBODIMENTS

Figure 3:
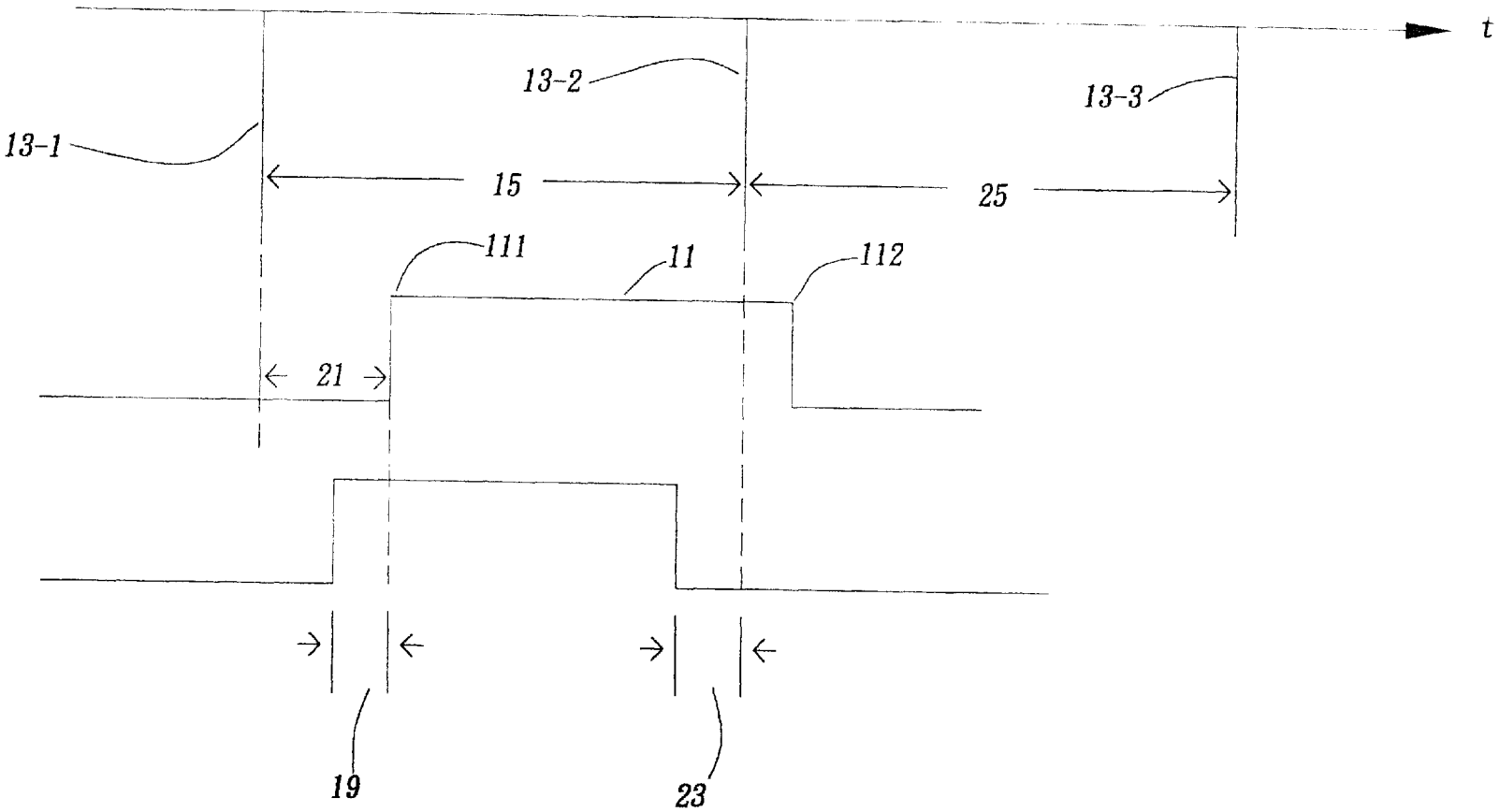
FIG. 3 shows the relation between the active part of a video signal and synchronous pulses in adjusting the active part of the video signal according to the present invention.

Now refer to FIG. 3 for describing a process suggested by the present invention for adjusting, according to a sequence of synchronous pulses 13-1, 13-2, 13-3, . . . , and right after the starting synchronous pulse 13-1, the timing of the active part 11 of a video signal to be displayed in a region specified for displaying the image of the video signal line by line. The process comprises the steps of:

(1). detecting if the trailing end 112 of each active part of 11 the video signal lags the synchronous pulse 13-2 which is next to the leading end 111 of the active part 11 of the video signal, in order to detect if the image defined by each active part of the video signal falls beyond the right boundary of the region specified for displaying the image;

(2). in case the trailing end 112 of an active part 11 of the video signal lags the synchronous pulse 13-2 which is next to the leading end 111 of the active part 11 of the video signal, advancing the active part 11 of the video signal by an adjustment step value 19 in the cyclical period following the synchronous pulse 13-2, i.e., if the image defined by an active part of the video signal 11 falls beyond the right boundary of the region specified for displaying the image, the image displayed in the next line will be moved to the left by a distance corresponding to the adjustment step value 19;

(3). repeating step (1) and step (2) with synchronous pulses 13-2, 13-3, . . . , one by one as the starting synchronous pulse each time until the trailing end 112 of the active part 11 of the video signal leads, by a leading time period 23, the synchronous pulse 13-2 which is next to the leading end 111 of the active part 11 of the video signal, the leading time period 23 has minimum length of zero, i.e., repeating step (1) and step (2) until the trailing end 112 of the active part 11 of the video signal in each cyclical period 25 does not lag the synchronous pulse 13-2 which is next to the leading end 111 of the active part of the video signal, in order to put, as soon as possible, the image of the video signal back in the region specified for displaying the image line by line.

FIG. 3 is again referred to for describing a process in displaying, according to a sequence of synchronous pulses 13-1, 13-2, 13-3, . . . , as well as a tentative lag value, and right after the starting synchronous pulse 13-1, a video signal in the region specified for displaying image line by line. The process comprises the steps of:

(1). waiting a time period 21 after the starting synchronous pulse 13-1 to start the active part 11 of the video signal, the time period 21 being equivalent to the tentative lag value;

(2). detecting if the trailing end 112 of the active part 11 of the video signal lags the synchronous pulse 13-2 which is next to the leading end 111 of the active part 11 of the video signal;

(3). in case the trailing end 112 of the active part 11 of the video signal lags the synchronous pulse 13-2 which is next to the leading end 111 of the active part 11 of the video signal, decreasing the tentative lag value by an adjustment step value;

(4). repeating steps (1), (2), (3) with synchronous pulses 13-2, 13-3, . . . , one by one as the starting synchronous pulse each time until the trailing end 112 of the active part 11 of the video signal leads, by a leading time period 23, the synchronous pulse 13-2 which is next to the leading end 111 of the active part 11 of the video signal, the leading time period 23 has minimum length of zero. The image of the video signal is thus put back, as soon as possible, in the region specified for displaying the image line by line.

Figure 1:
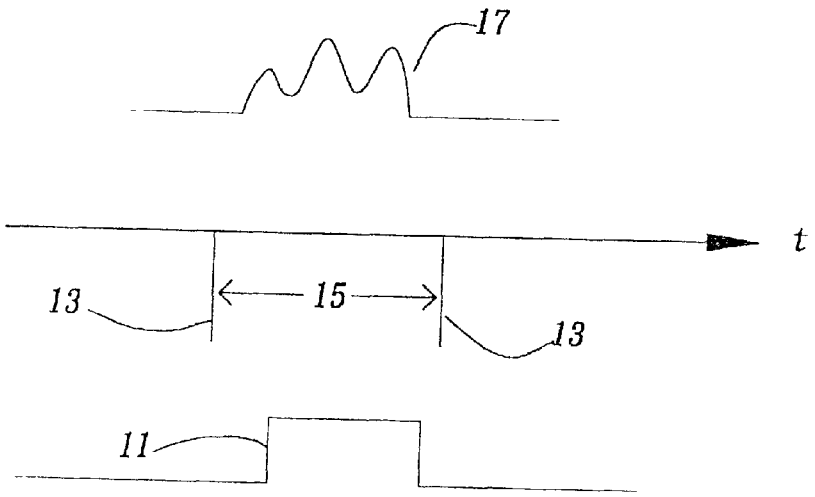
FIG. 1 shows the relations between the displayed image of a video signal, synchronous pulses, and the active part of the video signal.
Figure 4:
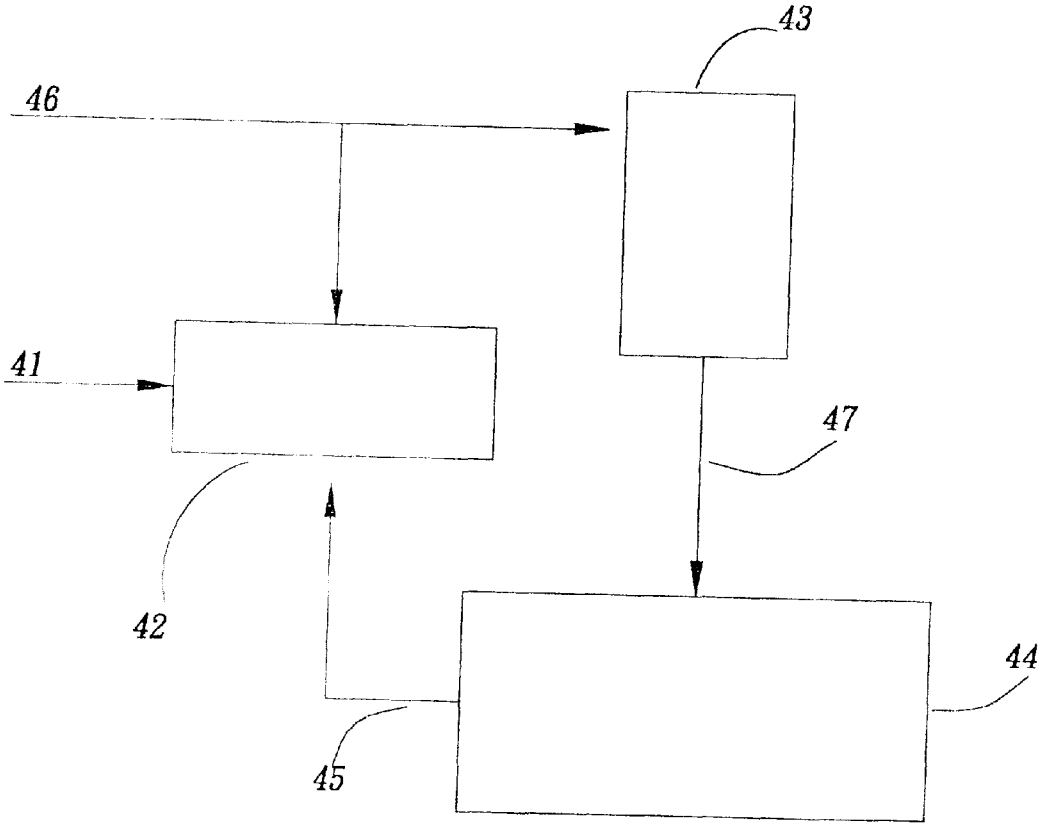
FIG. 4 shows a block diagram for illustrating an algorithm embodiment according to the present invention.
Figure 2A:
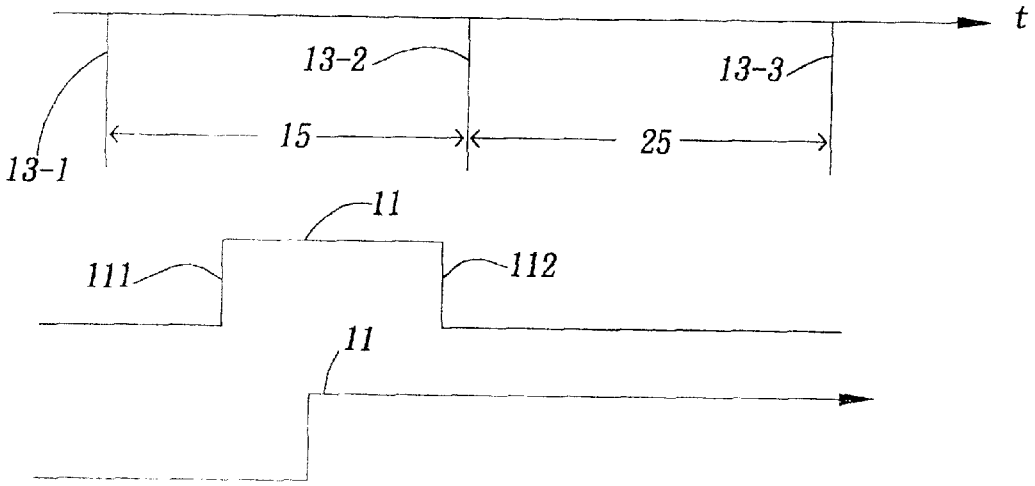
FIG. 2*a* shows a case for synchronization failure possibly existing in a conventional video signal display system.
Figure 2B:
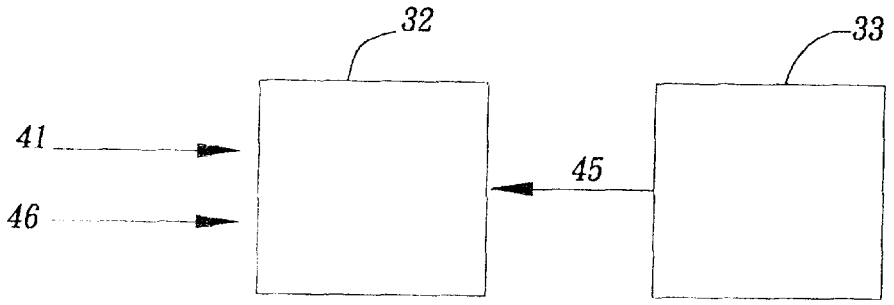
FIG. 2*b* is a block diagram showing a conventional algorithm for adjusting the timing of the active part of the video signal for displaying image line by line.

A block diagram for illustrating an algorithm embodiment according to the present invention is shown in FIG. 4, where process 42 inputs video signal 41, a screen starting point signal 45, and synchronous pulse 46, to define the range for the active part of the video signal (i.e., to specify the point for starting and ending the active part of the video signal in order to display image in a specified region on screen), logic circuit 43 such as a flip-flop inputs synchronous pulse 46 and the active part of the video signal defined by process 42, and outputs a lag meaning signal 47 to CPU 44 if the trailing end of the active part of the video signal lags the synchronous pulse which is next to the leading end of the active part of the video signal, so that CPU 44 computes to obtain the screen starting point signal 45 (corresponding to the leading end of the of active part of the video signal, for specifying the point to start displaying image on the screen) to be applied in process 42 for adjusting the timing of starting image displaying (i.e., for adjusting the phase the active part of the video signal lags the synchronous pulse for next cyclical period).

Figure 5:
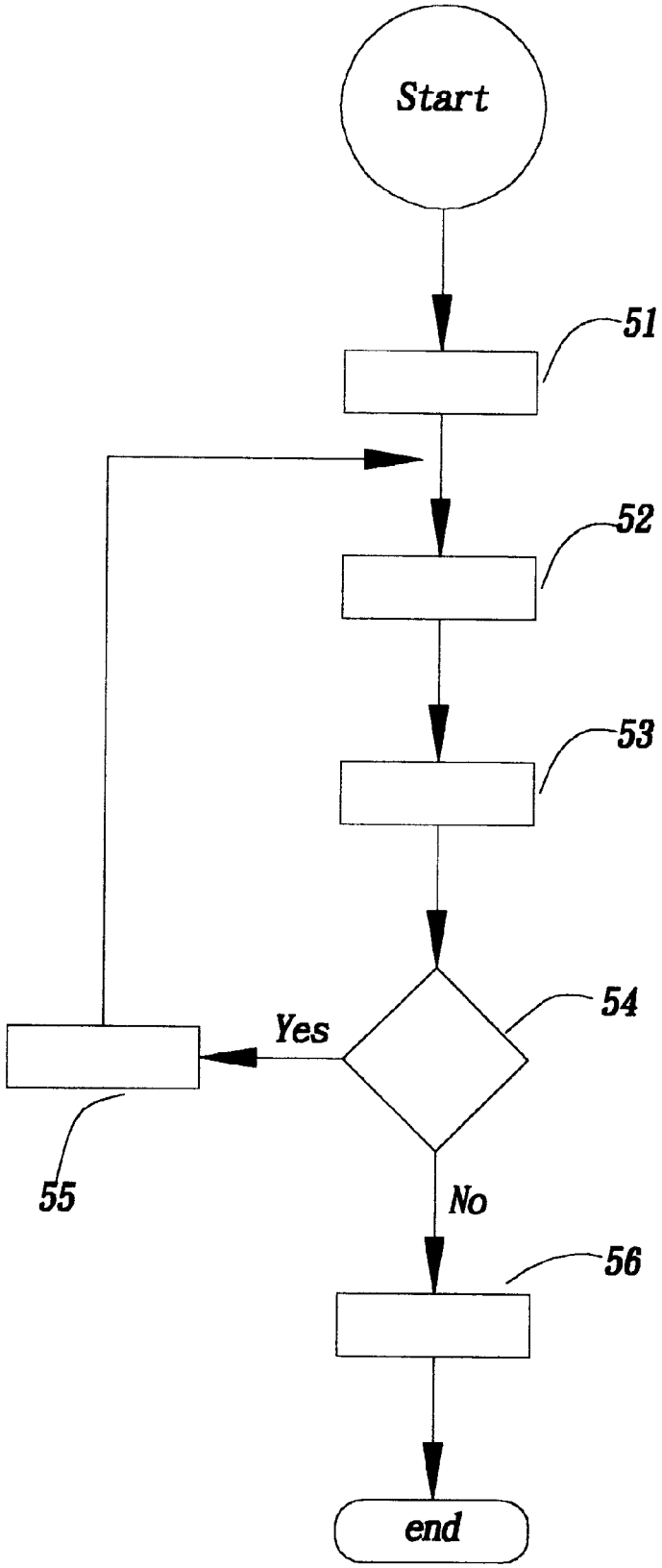
FIG. 5 shows a flow chart for illustrating an embodiment of the present invention.

A flow chart for illustrating an algorithm embodiment according to the present invention is shown in FIG. 5, where step 51 is for choosing a tentative lag value; step 52 is to wait a time period (such as 21 in FIG. 3) after the synchronous pulse (such as synchronous pulse 13-1 in FIG. 3) for starting the active part (such as 11 in FIG. 3) of the video signal, the time period is equivalent to the tentative lag value, i.e., the leading end (such as 111 in FIG. 3) of the active part of the video signal lags the starting synchronous pulse (such as 13-1 in FIG. 3) a time period equivalent to the tentative lag value; step 53 for ending the active part of the video signal when the time following the leading end (such as 111 in FIG. 3) is equivalent to an active part length value which is usually specified by a display system, i.e., step 53 is to determine where the trailing end (such as 1 12 in FIG. 3) of the active part of the video signal shall be; step 54 for detecting if the trailing end (such as 112 in FIG. .3) of the active part of the video signal lags the synchronous pulse (such as synchronous pulse 13-2 in FIG. 3) which is next to the leading end (such as 111 in FIG. 3) of the active part of the video signal, in case the trailing end of the active part of the video signal lags the synchronous pulse which is next to the leading end of the active part of the video signal, go to step 55, otherwise go to step 56; step 55 for decreasing the tentative lag value by an adjustment step value; step 56 for recording the tentative lag value for starting displaying a video signal next time.

It can be seen now the tentative lag value for step 52 is updated by decreasing with an amount equivalent to the adjustment step value whenever the trailing end (such as 112 in FIG. 3) of the active part of the video signal lags the synchronous pulse (such as synchronous pulse 13-2 in FIG. 3) which is next to the leading end (such as 111 in FIG. 3) of the active part of the video signal, thereby step 52 may advance, in the cyclical period (such as 25 in FIG. 3) following the synchronous pulse (such as synchronous pulse 13-2 in FIG. 3) which is next to the leading end (such as 111 in FIG. 3) of the active part of the video signal, the active part of the video signal by a time period (such as 19 in FIG. 3) equivalent to the adjustment step value, until the trailing end of the active part of the video signal doesn't lag the synchronous pulse which is next to the leading end of the active part of the video signal, i.e., until the displayed image falls in the specified region of the display.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A process in adjusting, according to a sequence of synchronous pulses, the timing of the active part of a video signal for displaying, comprising the steps of:

(1) detecting if the trailing end of the active part of said video signal lags the synchronous pulse which is next to the leading end of the active part of said video signal;

(2) in case the trailing end of the active part of said video signal lags the synchronous pulse which is next to the leading end of the active part of said video signal, advancing the active part of said video signal by an adjustment step value;

(3) repeating step (1) and step (2) until the trailing end of the active part of said video signal leads, by a leading time period, the synchronous pulse which is next to the leading end of the active part of said video signal, said leading time period has minimum length of zero.

2. The process according to claim 1 further comprising, before step (1), a step of choosing a tentative lag value, and wherein step (2) comprises the steps of:

(2-1) decreasing said tentative lag value by said adjustment step value;

(2-2) waiting a time period after said synchronous pulse to start the active part of said video signal, said time period being equivalent to said tentative lag value, whereby the active part of said video signal is advanced by said adjustment step value.

3. The process according to claim 2 wherein step (3) comprises the step of:

when the trailing end of the active part of said video signal leads, by a leading time period, the synchronous pulse which is next to the leading end of the active part of said video signal, and said leading time period has minimum length of zero, recording said tentative lag value for next time to start said process.

4. The process according to claim 1 further comprising, before step (1), a step of choosing a tentative lag value, and wherein step (2) comprises the steps of:

(2-1) decreasing said tentative lag value by said adjustment step value;

(2-2) starting, in response to said synchronous pulse, to count a sequence of clock pulses to obtain a counting number;

(2-3) starting the active part of said video signal when said counting number being equivalent to said tentative lag value, whereby the active part of said video signal is advanced by said adjustment step value.

5. The process according to claim 4 wherein step (2-2) further comprises a step of providing said sequence of clock pulses.

6. The process according to claim 2 wherein step (2-2) further comprises steps of starting a timer in response to said synchronous pulse, and starting the active part of said video signal when said time period is counted.

7. The process according to claim 1 further comprising, before step (1), a step of choosing said adjustment step value.

8. The process according to claim 2 wherein said time period is equivalent to said tentative lag value when the difference between said time period and said tentative lag value is within a certain range.

9. The process according to claim 2 wherein said time period is equivalent to said tentative lag value when said time period equals said tentative lag value.

10. The process according to claim 1 wherein step (1) further comprises a step of inputting the active part of said video signal and said synchronous pulses to a flip-flop, for detecting if the trailing end of the active part of said video signal lags the synchronous pulse which is next to the leading end of the active part of said video signal.

11. A process in displaying a video signal according to a sequence of synchronous pulses and a tentative lag value, comprising the steps of:

(1) waiting a time period after said synchronous pulse to start the active part of said video signal, said time period being equivalent to said tentative lag value;

(2) detecting if the trailing end of the active part of said video signal lags the synchronous pulse which is next to the leading end of the active part of said video signal;

(3) in case the trailing end of the active part of said video signal lags the synchronous pulse which is next to the leading end of the active part of said video signal, decreasing said tentative lag value by an adjustment step value;

(4) repeating steps (1), (2), (3) until the trailing end of the active part of said video signal leads, by a leading time period the synchronous pulse which is next to the leading end of the active part of said video signal, said leading time period has minimum length of zero.

12. The process according to claim 11 further comprising, before step (1), a step of choosing said adjustment step value which is not bigger than said tentative lag value.

13. The process according to claim 11 wherein step (4) further comprises a step of recording said tentative lag value when the trailing end of the active part of said video signal leads, by a leading time period, the synchronous pulse which is next to the leading end of the active part of said video signal, said leading time period has minimum length of zero whereby said tentative lag value is used for next time to start said process.

14. The process according to claim 11 wherein step (1) comprises steps of (1-1) starting, in response to said synchronous pulse, to count a sequence of clock pulses to obtain a counting number;

(1-2) starting the active part of said video signal when said counting number being equivalent to said tentative lag value.

15. The process according to claim 14 wherein in step (1-2) said counting number being equivalent to said tentative lag value if the difference between said counting number and said tentative lag value is in a certain range.

16. The process according to claim 14 wherein in step (1-2) said counting number being equivalent to said tentative lag value if said counting number is equal to said tentative lag value.

17. The process according to claim 14 wherein step (1-1) further comprises a step of providing said sequence of clock pulses.

18. The process according to claim 11 wherein step (1) further comprises a step of starting a timer in response to said synchronous pulse, and starting the active part of said video signal when said time period is counted.

19. The process according to claim 14 further comprises, before step (1) a step of determining an active part length value which is not larger than the period of said sequence of pulses, and wherein step (1) further comprises:

(1-3) when said counting number being equivalent to said tentative lag value, starting to count said sequence of clock pulses to obtain a counting number for active part length;

(1-4) ending the active part of said video signal when said counting number for active part length being equivalent to said active part length value.

20. The process according to claim 11 wherein step (2) further comprises a step of inputting the active part of said video signal and said synchronous pulse to a flip-flop for detecting if the trailing end of the active part of said video signal lags the synchronous pulse which is next to the leading end of the active part of said video signal.

* * * * *